US006786114B2

(12) United States Patent
Woodsum

(10) Patent No.: US 6,786,114 B2
(45) Date of Patent: Sep. 7, 2004

(54) GRIPWHEEL DRIVER AND METHOD OF ATTACHMENT TO OBTAIN UNIQUE PROPERTIES

(76) Inventor: David Arthur Woodsum, 2623 Gladiolus St., New Orleans, LA (US) 70122

( * ) Notice: Subject to any disclaimer, the term of this patent is extended or adjusted under 35 U.S.C. 154(b) by 0 days.

(21) Appl. No.: 10/022,625

(22) Filed: Dec. 13, 2001

(65) Prior Publication Data

US 2002/0092380 A1 Jul. 18, 2002

Related U.S. Application Data

(63) Continuation-in-part of application No. 09/309,640, filed on May 11, 1999, now abandoned.

(51) Int. Cl.[7] ..... B25B 17/00

(52) U.S. Cl. ..... 81/57.31; 81/57; 81/58.1; 81/490

(58) Field of Search ..... 81/57, 57.31, 57.42, 81/58.1, 63.2, 62.6, 63.1, 490

(56) References Cited

U.S. PATENT DOCUMENTS 2,031,133 A * 2/1936 Schumann ..... 81/476
3,823,624 A * 7/1974 Martin ..... 81/177.2
5,711,193 A * 1/1998 Eggert et al. ..... 81/58.1
5,947,212 A * 9/1999 Huang ..... 173/216
6,012,359 A * 1/2000 Lin ..... 81/57.31
6,035,746 A * 3/2000 Lin ..... 81/57.31
6,311,787 B1 * 11/2001 Berry et al. ..... 173/176
6,457,385 B1 * 10/2002 Hu ..... 81/57.3

* cited by examiner

*Primary Examiner*—Joseph J. Hail, III
*Assistant Examiner*—Anthony Ojini

(57) ABSTRACT

A hand operated device and method for assisting a user in driving the device's shaft to impart driving force to a fastener more than conventionally accomplished in a fixed period of time. The device has a first member and a second member gripped with the user's first hand, while a handle of the shaft is held with the user's second hand. The user then turns the second member in a first direction, while still gripping the first member, so as to rotate the shaft. Next, the user releases grip on the second member while rotating the first member in a second direction, freely, without the first member ever rotationally engaging the shaft. Simultaneously, the user grips and rotates the handle in the first direction so as to continue to rotate the shaft. The user then repeats the aforementioned steps to drive the shaft as desired so that the first member never rotationally engages the shaft.

15 Claims, 2 Drawing Sheets

GRIPWHEEL DRIVER ASSEMBLY

GRIPWHEEL ON TOOL FRONT-VIEW

DRIVER HANDLE'S FORE-PORTION 25 SIDE-VIEW

ALTERNATE FIG 5A-25

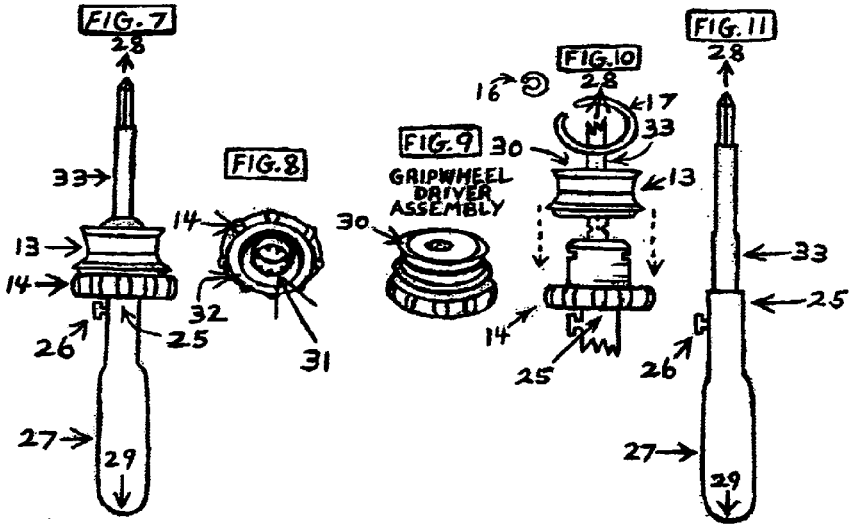
FIG. 12
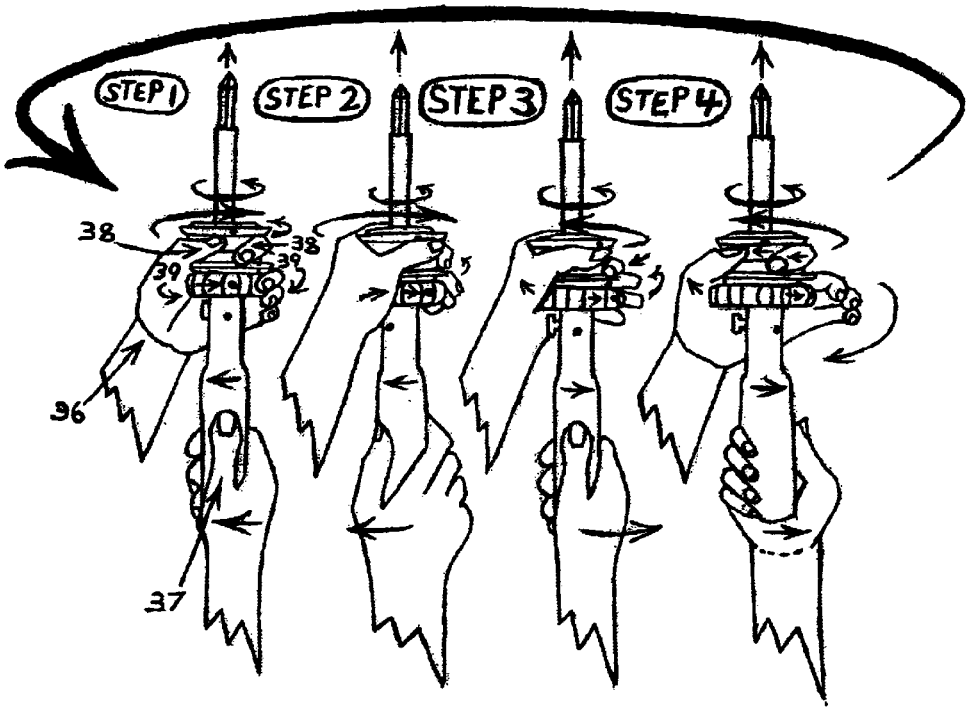

GRIPWHEEL DRIVER AND METHOD OF ATTACHMENT TO OBTAIN UNIQUE PROPERTIES

CROSS REFERENCE TO RELATED APPLICATION

This application is a continuation in part of application Ser. No. 09/309,640 filed May 11, 1999, now abandoned entitled Gripwheel Driver Assembly and Method Of Use.

BACKGROUND OF THE INVENTION

1. Field of the Invention

The present invention relates to assemblage-of-a-gripwheel-handle-apparatus as attached upon a driver-device so-that, by utilization of the apparatus, the driver-device can be more continuously actuated and handled.

2. Description of Prior Art

Driver-devices, of a type as like that of hand operated ratchet drivers, are designed to eliminate both the need for disengaging from a fastener to return for another leg of spinning the driver's handle and to eliminate the need for reconfiguring the grip to begin application of another spin of the driver's handle, disengaging and grip reconfiguring being operations necessary for rotation of a fastener in absence of a ratcheting mechanism. By eliminating the aforementioned operations, the time saved can be applied to just rocking the driver's handle back an forth with the hand, thereby increasing the number of rotational cycles and speeding rotation of the fastener. However, due to the fact that many fasteners are not snug enough to generate the frictional resistance required to cause the ratchet mechanism to ratchet, the opposing hand must, at times, be used to supply the additional frictional resistance. When a means is not provided to keep the hand poised in readiness while waiting to apply the resistance, applied only during return strokes, the hand must continually reconfigure on each successive cycle to correct apply the added resistance, thus consuming much of the time saved by using the ratchet driver. If it becomes necessary for the fastner's spin to be reversed for any reason, the user must stop, reset the ratchet mechanism for reverse, spin the fastener, then stop, reset the ratchet mechanism for forward, and resume operation; the resetting of the mechanism wastes an additional period of time. Furthermore, since the hand which is already positioned on the side of the driver's shank to apply the additional resistance "could ", but being it lacks an efficient means to engage the shank and therefore "cannot" effectively continue spinning the fastener, the return cycle is left unproductive ad its potential is not fully realized. In addition, when a-hand-grips-the-shank-from-a-location-on-side-the-shank-to-spin-the-shank, it is not quite in a spacial orientation such that it can rotate a distance equal to the distance rotated by a hand gripping-on-a-driver's-handle-at-rear-of-the-driver, a rotating ratio of two to three. Therefore a driver would benefit from a gripwheel-handle-apparatus-as-upon-a-driver-device-assemblage-method which does result in the formation of an apparatus that enables a user's hand utilizing-the-apparatus to act a role of clutch, like a second ratchet mechanism, which normally would be necessary inside the driver in order to have the driver's shank move easily within the hand to achieve an alternate two handed continuous spin of the shank. Having had assembled-a-grip-wheel-apparatus-upon-a-driver-device using such method would result in enabling a hand utilizing the apparatus to be correctly positioned to manipulate the shank as needed, thus freeing-space-inside-the-driver so permitting installation of, and enabling both the driver and the apparatus together to offer as platform to support a means for stepping up the movement of the shank relative the movement of a hand which, while positioned along side the shank, spins the shank. Finally, since rocking the driver's rear-handle back and forth makes it difficult to hold the driver steady upon a fastener, the driver would benefit from an efficient means to guide the fore-portion of the driver against the work while operating the driver.

SUMMARY OF THE INVENTION

It is therefore an object of the invention to equip a driver-device, a device having both a handle and shank extending perpendicularly from the handle, with an auxiliary handle apparatus, called herein a gripwheel, used as both a second-handle, for holding and spinning the driver's shank, and as a guide means, used to aid in guidance of both the driver and a second operating hand. The apparatus to be assembled is comprised of two separate positioned, shaped, utilized, and functioning halves, a hand utilized, discretely-independently-rotatable, slip-ring-type hand held guide half, and a rotatable, hand-operated, driver-shank's, drive-means half called a drive-wheel herein. And both halves are "assembled" upon a driver-device-of-the-type-as-described-which has -both-handle-and-shank-extending-perpendicularly-from-the-handle, but to describe further the-driver-device and the-assemblage, the driver device's handle is also turnable-the-shank and the assemblage of the halves, being as that are-the-apparatus, is accomplished through way of utilizing the method of assemblage, which is the invention, prescribed herein, to enable a one portion of a hand grasping upon the guide half of the apparatus to direct the driver's shank toward the work and also, through way of gripping upon the guide, secure the one hand portion both linearly fixed relative plus rotatable relative the shank as axis, thereby positioning an unencumbered second portion of the hand to simultaneously, at will, grasp for holding or grasp for spinning the hand-operated drive-wheel of the apparatus; and in addition, through the grasp of the drive-wheel also enable the drive-wheel to (1) be means for the hand's second portion to aid in guidance of the driver; (2) be means for the hand's second portion to supply additional frictional resistance for augmenting ratcheting of the driver when the driver is a ratchet type applied to loose-fitted-work; (3) be means for the hand's second portion to reverse the spin of the driver's shank without having to reset the ratcheting direction of the driver and; (4) be means for the hand's second portion to continue productive spinning of the shank during the opposing hand's unproductive driver-handle return strokes. To accomplish the aforementioned results the said guide and drive-wheel are structured as two separate shaped, positioned, utilized, and functioning halves, sized such that the distance from at lease one axially-parallel-outward-surface of the guide to-a-line-to-be true axis of the guide, the line being through-the-guide is essentially the same as the distance from the overall axially parallel outward surface of the drive-wheel to true axis of the drive-wheel, the driver-device's shank to be used in the position of and collinear with the true axis as running perpendicularly through both components, and both components are sized plus positioned relative each other so when placed in line about the driver's shank in the position of true axis, a hand is able to grasp both components simultaneously, and the hand-held-guide's shank-parallel outward-surface is shaped to enable holding in position on the guide any one portion of a hand grasping on the-shank-parallel-outward-surface of the said guide, while the drive-wheel's shank-parallel-outward-surface is shaped for enabling ease of simultaneously, along with the said holding-of-the-guide-by-a-one-portion-of-said-hand, having the wheel intermittently gripped, held, spun, and released by the grasp of any remaining-not-utilized-on-the-guide second portion of the same said hand; and additionally, the drive-wheel being separate as an independently enacted half of the apparatus, should be of a type shaped with bluntly curved surfaces substantially uniformly symmetrical about the axis of the wheel, so enabling the wheel to rotate within the grasp of such a releasing, not-utilize-on-the-guide, second portion of the said hand, so that the, not-utilized-on-the-guide, second portion of the said handle is able to remain in position for gripping the drive-wheel, and yet also is able to rotate about the drive-wheel near or lightly touching the drive-wheel's surface, due to anchoring through linkage with said hand's one portion which remains utilizing the guide, the guide in addition being discretely independently free-to-be-spun. The handle apparatus's method of assemblage so-as-attached-upon-a-driver-device comprises having the slip ring type hand held guide attached-about-a-driver-device's-shank by being slipped into place "loosely discretely, axially rotatably, girdling-the-said-driver's-shank so as free from axially-rotatably-engaging the driver's shank, the shank used as axis for the guide's rotation by running perpendicularly through the guide, the guide linearly retained in the guide's location-about-the-shank, the location being adjacent-in-line-forward the drive wheel half the apparatus, which-also-rings-the-shank, the guide thereby being nearer the shank's work end than the wheel, the guide being as aforesaid girding, also being discretely independently free-to-be-spun unlimited in distance and/or direction relative the driver's shank as axis for the spin and relative the apparatus's drive-wheel being separate utilized as in that independently enacted while half the apparatus, and in-order-to-be-as afore-described the guide has the shank inserted "through a bore through the guide, the bore larger in diameter than the shank and piercing through the guide", the shank inserted to a distance through the guide's bore so rearward of in fine with the shank's work-end, such that the shank is running perpendicularly lengthwise through the guide's bore, and the shank is running perpendicularly-lengthwise-through-the-guide's-bore either by being inserted "alone" perpendicularly through the guide's bore, "the shank Immediate the guide", or by being inserted perpendicularly together with, and as running lengthwise perpendicularly through, another component inserted through the guide's bore, the guide's bore as girding the other component at the same location lengthwise on the other component as where the shank is running perpendicularly lengthwise through the other component, "thus the shank is still, as afore-described, running perpendicularly lengthwise through the guide"; and additionally the apparatus's method of assemblage comprises having the drive-wheel-half-the-apparatus-attached-about-a-driver-device's-shank "ringing so axially rotatably encircling utilizing a manner of "engaging to spin" the said driver's shank, the shank as being perpendicularly running through both the drive-wheel and the guide, while the shank also is used at/collinear with axis for the wheel's rotation", the wheel as being linearly retained in Its location about the shank, the location being adjacent-in-line-rearward the guide-half-the-apparatus and further away from the shank's work-end than the guide which-also-girdles-the-shank, the wheel thereby being forward the fore-portion of the driver's handle and nearer the fore-portion than the guide, the driver's handle having always been a part of the driver extending from plus engaging with the driver's shank-portion emanating out from opposite-the-side-of-the-apparatus-from-the-side-facing-the-shank's-work-end, the handle having been for spinning the driver's shank, the wheel being as, aforesaid-engaging, also being such that will spin the shank when spun while the guide is being such that will spin discretely independent the wheel and shank when spun, thus the driver's handle is in line rearward the drive-wheel, the drive-wheel is in turn, in line juxtaposing rearward the guide, and the guide is in turn, in line rearward the work-end of the shank and both the gripwheel halves, the guide and wheel, are mounted advantageously positioned near enough each other between the fore-portion of the driver's handle and the driver-shank's work end, such that a single hand is able to simultaneously grasp both the guide and drive-wheel utilizing them as bi-longitudinally supporting halves. And at least one retainer is placed, a retainer in front of the hand-held-guide's side which faces the shank's work end, to help retain the components in assembled operating position. The manner of the wheel's engagement with the shank to spin the shank can be in either one of two ways, one by having the wheel ring the shank so as to encircle "fixed" to the shank or two by having the wheel ring the shank so as to encircle "rotatable relative the shank", the shank being in the position of and collinear with axis for the wheel's rotation therefore the shank is inserted perpendicularly as "loosely-fitted" through a bore through the wheel, the shank's insertion through the bore being either as "immediate" the wheel or by way of running perpendicularly lengthwise through another component inserted through the drive-wheel's bore, but the wheel still engaging the shank by also being dressed to engage the shank through linkage by way of a drive-train to spin the shank. The means utilized to effect the drive-wheel's engagement with the shank being as can be of any type including 1, having the shank's outside surface expanded and reshaped to form the drive-wheel component, by 2, dressing the inner surface of a bore through the drive-wheel with means which causes the wheel to grip the shank's surface so that the drive-wheel can have the shank inserted through the bore with the means causing the shank to be fixed to the wheel, or by 3, having a geared-internal-drive-train attached to the wheel and linking the wheel such that engaging the shank as like when the wheel engages by the manner in which the wheel is rotatable relative the shank, for example, a train as comprised of a loosely girdling the shank beveled-driving-gear centered and filed to the drive-wheel's internal face, the drive-gear's teeth engaging a beveled-idler-gear able to spin being mounted at its center about an axle affixed to the driver handle's fore-portion, the same beveled-idler-gear having its teeth engaging a step-up-beveled-gear able to spin being mounted at its center about an axle affixed to the driver handle's fore-portion, the step-up beveled-gear engaging a ringing the shank while engaging the shank driven-gear; and the aforementioned gearing arrangement can be repeated in bilaterally symmetrical fashion on the shank's opposite side. Such a drive-train would be for increasing the speed of the shank's spin relative the speed of the drive-wheel's spin, thus compensating for any difference in the ability of one hand to spin the drive-wheel versus the other hand to spin the driver's rear-handle, a difference due to spacial orientation. The manner of guide's being as discretely independently freely-able-to-be-spun, unlimited in distance and direction, including relative both the driver's shank and the apparatus's drive,wheel, can be in either one of two ways, one way being having a bore through the guide sized so that the shank can be directly inserted loosely fitted through the bore, the shank as "immediate" of the guide, thereby the shank acts as axle for the guide which, being also as a discretely separate component, is thus discretely-independently freely-able-to-be-spun unlimited in distance and direction relative the driver's shank and the apparatus's drive-wheel or the guide can also be discretely independently freely-able-to-be-spun-relative-the-shank-and-drive-wheel by having another component inserted loosely fitted through the guide's bore, the other component in turn ringing the shank at the same location relative the length of the other component as where the other component is inserted through the guide's bore, the guide thus encircles the other component yet, consecutively, also encircles the shank, the guide being freely-able-to-be-spun-including-relative-both-the-shank-and-the-wheel. As for example, the bore could be sized so that an extension of the drive-wheel's hub can be inserted loosely fitted into the guide's bore, the drive-wheel's hub, as inserted through the bore, would then act as axle for the guide, the guide thus, as a discretely separate component, is thereby discretely independently freely-able-to-be-spun relative the hub; however the shank would, in turn, be inserted running lengthwise perpendicularly through the hub, the insertion-of-the-shank through the hub being such that at the same location relative the length of the hub as the hub is running through the guide, thus the guide as a discretely separate component is enabled to be discretely-independently freely-able-to-be-spun relative the hub, relative the shank-that's-running-through-the-hub, and relative the drive-wheel which is the other-half-of-the-apparatus separate from the guide but unitized with the hub. Although the manner-of assembling-the-guide as attached-upon-a-driver-device can be in either one of two ways, the means to effect the assemblage as such can be only one, that is by having the guide rotationally unengaged, not engaged, either by direct and/or by indirect means, to the shank as axis for the guide's rotation.

As described heretofore and as further described herein, the Invention, an assemblage-method of an auxiliary handle apparatus, a gripwheel, as-attached-upon-driver-device provides the driver-device with a second handle that is both a guide and a second drive-means combined in a manner so forming an apparatus for handling the said driver more efficiently, augmenting operation of the said driver, and increasing the distance the driver's shank can be turned during application cycles. The apparatus's capability of providing such as afore-described and as described further here is due to having the two separate yet bilaterally supporting halves assembled as in the manner herein prescribed attached upon a driver-device, the forward-half-the-handle-apparatus, being the slip-ring-type hand held guide, mounted-such-that-to-spin-discretely-independently-freely-about-the-driver's-shank but while also situated as described further herein to follow, and the rear-half-the-apparatus, being the hand operated drive-wheel, mounted-to-engage-the-shank-for-holding-or-spinning-the-shank but also while situated as described further herein to follow, both the halves securely positioned location-fixed-about/as-relative-a-driver-device's-shank while configured to be separately yet simultaneously utilized by a singe hand.

A preferred method of operating the apparatus while assembled upon a driver-device would be to have a user clutch the slip ring type hand-held-guide between a thumb and at least one finger of a hand to direct the driver's shank against work and, as needed, simultaneously bear down with the free portions of the same hand to grasp and hold or grasp and spin the shank engaged, hand-operated drive-wheel for holding or spinning the shank. The grasping and holding or grasping and spinning may be timed to occur during return strokes of the user's other hand which operates the driver's handle. Clutching the hand-held-guide by a portion of a hand to guide the shank also serves to hold the unencumbered portions of the same hand in a position to utilize the drive-wheel. The assembly in whole form is effective for augmenting the ratcheting of a ratchet driver applied to loose fitted work, via grasping and holding of the hand operated dive-wheel, when the holding is timed to occur during return strokes of the driver's handle. But additionally, the apparatus can be used with any driver-device fitted with the invention, to further spin the driver's shank during application cycles through spinning the hand operated drive-wheel on normally unproductive return-stroke-periods of the driver'handle.

BRIEF DESCRIPTION OF THE DRAWINGS

In the drawings identical components are identified with identical reference numbers and lettering.

Figures 1, 2, 3, 4, 5, 5A, 5B, 6, 7, 8, 9, 10, 11, 12, 13, 14, 15, 16, 17, 18, 19, 20, 21, 22, 23, 24, 25:
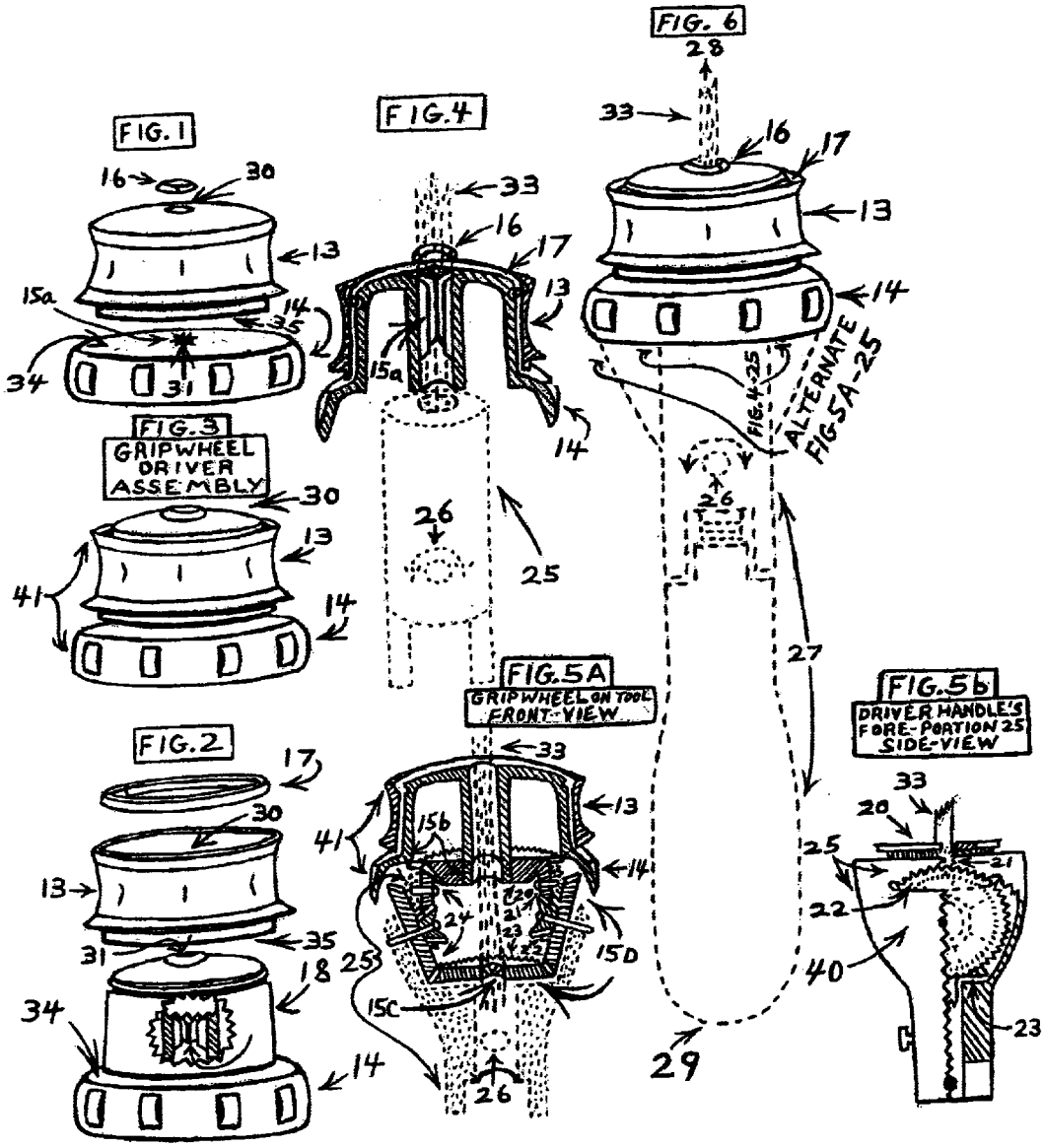
FIG. 1 is an exploded-perspective-side-view-of-the-gripwheel-handle-apparatus, the present invention,] illustrating shapes which can be used for the slip ring type hand-held-guide, half-the-apparatus, and hand-operated-drive-wheel, other-half-the-apparatus, which fall within scope of being gripwheel components as assembled herein; additionally the figure helps illustrate the method of the gripwheel's assemblage such-that-attached-upon-a-driver-device of type as afore-described herein, yet in FIG. 1 the gripwheel is shown isolated from the driver-device, but the gripwheel needs to be enabled for such an assemblage, thus the Figure still helps illustrate the assemblage such that in-accordance-with-the-method-of-assemblage as described herein by illustrating the gripwheel shown enabled for the assemblage, thus the FIG. 1 helps illustrate the assemblage method, which includes having the "guide" mounted discretely-independently freely-able-to-be-spun-as-relative-a-shank and while girdling attached about the shank, the shank being of a driver-device type already having a handle and shank extending perpendicularly from the handle, by having the guide shown as enabled to be assembled such that attached about the shank using one of the two alternate manners in which the guide can be enabled such that will assemble-in accordance-with-the-herein-required-method upon-a-driver-device such-that-part-of-the-gripwheel-apparatus, the manner illustrated in FIG. 1 being the slip ring type hand-held-guide is configured to loosely discretely girdle a driver-device's shank, by being "immediate" of the shank, through way of a bore through the guide sized so that the shank can be directly inserted loosely fitted through the guide's bore, the specific means enabling the guide to be freely able to be spun, being only one possible, is having the guide not enabled to axially-rotatably engage the shank inserted through the guide's bore by having the bore smooth enough and loose enough about the shank so as not to engage but yet still permit the guide to be linearly retained in the location about the shank by way of a retainer such as the retainer ring illustrated in the FIG. 1; and the FIG. 1 helps further illustrate the apparatus's assemblage method, which includes having the drive-wheel mounted about such that attached ringing so encircling "engaging" the same shank-as-the-guide-girdles, the shank being of a type driver-device afore-described herein which already has a handle and shank extending perpendicularly from the handle, by illustrating one of the two alternate manners in which the "drive-wheel" can be enabled for such an assemblage-as-in-accordance-with-the-herein-described-assemblage-method, the manner shown in FIG. 1 being having the wheel configured to ring a shank such-that-attached "fixed-to-the-shank" thereby engaging the shank, the specific means in FIG. 1 enabling such fixed engagement being jagged surface ridges inside a piercing through the drive-wheel bore, the bore sized small enough for the drive-wheel to be tightly press fitted onto a shank, the shank being inserted through the bore, thereby the wheel rings the shank while the bore's ridges dig into the shank's surface fixing the wheel to the shank, but any one out of several means can be used to fix the wheel to the shank.
FIG. 2 is an exploded perspective side view of the gripwheel handle apparatus, the present invention, illustrating the alternate manner to that illustrated in FIG. 1 for enabling the slip ring type hand-held-guide, half the apparatus, to be such that will assemble as-part-of-the-gripwheel-apparatus in accordance with the herein required method comprising having the guide attached-about-such-that "loosely girdling-a-driver-device'shank-of-a-type-driver-as-afore-described-herein, such that discretely independently freely-able-to-be-spun including relative the shank and apparatus's drive-wheel"; and the manner that's illustrated in FIG. 2 which is in accordance with the herein required method, yet alternate to that in FIG. 1, has the guide enabled to loosely girdle a driver's shank through way of "loosely-girdling-another-component at a location lengthwise on the other component whereby the shank is to be inserted perpendicularly lengthwise through the other component"; and additionally the FIG. 2 also illustrates a manner for enabling the other half the apparatus, the "drive-wheel", to be such that will assemble as-part-of-the-gripwheel-apparatus in accordance with the herein required method which furthermore comprises having the wheel attached-about-such-that "ringing-a-driver's -shank-of-a-type-driver-as-afore-described-herein, engaging to spin the shank"; and out of two manners possible in accordance with the method, the FIG. 2 illustrates the same manner as utilized in the FIG. 1, the manner being to have the wheel enabled to ring-a-driver's-shank "fixed to the shank", but the FIG. 2 additionally illustrates that although the drive-wheel is enabled to be mounted as "fixed to a shank", it is possible for the specific means of fixing the wheel to the shank to be in any one out of several ways, exemplified in the FIG. 2 by having the means while similar to that shown In FIG. 1, additionally incorporate, as part of the means, a unitized construction of the drive-wheel with a hub.
FIG. 3 is an unexploded, external, side plan perspective view of the gripwheel-handle-apparatus of FIG. 1 and/or of FIG. 2 illustrating both the gripwheel's slip ring type hand-held-guide and hand operated drive-wheel as utilized juxtaposed adjacent-each-other-in-line such that a hand is able to grasp both the components simultaneously, and reveals that the exploded depictions of both the FIGS. 1 and 2 are essentially of the same apparatus in overall structure and use when the components are assembled as in compliance with the herein required method of assemblage such that permitting them to be utilized as prescribed.
FIG. 4 is a partial cross sectional front view of the gripwheel apparatus of FIG. 2 having the embodiment placed ready for operation about a phantom outlined portion of a driver-device's shank, of-type-driver-as-afore-described-herein; the figure reveals the apparatus as-assembled-such-that-attached-upon-the-driver-device in accordance with the herein required assemblage method comprising having the guide half the assembly attached-about-such-that "loosely discretely, axially-rotatably, girdling a-driver-device's-shank so as free-from-axially-rotatably-engaging the driver's shank, the shank being used as axis for the guide's rotation by running perpendicularly through the guide, the guide linearly retained in the guide's location-about-the-shank, the location being juxtaposed adjacent-in-line-forward the drive wheel half the assembly, which-also-rings-the-shank, the guide thereby being nearer the shank's work end than the wheel, the guide as aforesaid-girdling, also being as discretely independently free-to-be-spun unlimited in distance and/or direction including relative the driver's shank as axis for the spin and relative the assembly's drive-wheel as being separate utilized in that independently enacted while half the apparatus, the attachment of the guide being by way of having the shank inserted perpendicularly through a bore through the guide, the bore larger in diameter than the shank and piercing completely through the guide"; and, the FIG. 4 additionally reveals the apparatus's assemblage as-attached-upon-a-driver-device-in-accordance with-the-herein-required-assemblage-method being also comprising having the wheel half the apparatus as-such-that-attached-about "ringing so axially rotatably encircling, utilizing a manner of engaging-to-spin, the said driver's shank, the shank being both perpendicularly running through the wheel and used at/collinear with true axis for the wheel's rotation, the wheel linearly retained in its location about the shank, the location being juxtaposed adjacent in-line-rearward the guide-half-the-apparatus and further away from the shank's work-end than the guide, which-also-guides-the-shank, the wheel thereby being forward the fore-portion of the driver's handle and nearer the fore-portion than the guide, the driver's handle extending from plus engaging with the shank's portion emanating from-opposite-the-side-of-the-apparatus from the side facing the shank's work-end, the wheel being as, aforesaid-engaging, also being such that will spin the shank when spun while the guide is being such that will spin discretely independent the wheel when spun"; thus as shown in FIG. 4, the driver's handle is in line rearward the drive-wheel, the drive-wheel is in turn, in line juxtaposing rearward the guide, and the guide is in turn, in line rearward the work end of the shank, and the FIG. 4 illustrates the assemblage-of-the gripwheel as-being-upon-a-driver-device-and-as-in-accordance-with-the-aforesaid-required-method, being as accomplished by the manner and means in which the guide and drive-wheel are dressed to do so in FIG. 2.
FIG. 5A is a partial cross sectional front view of a gripwheel handle apparatus with the embodiment placed ready for operation as assembled upon a phantom outlined portion of a driver-device of-type-afore-described-herein, but differs from FIGS. 1, 2 and 4 by illustrating the only alternate manner, to that illustrated in FIGS. 1, 2 and 4, of having the "drive-wheel" enabled such-that will-assemble-upon-a-driver-device, while part of the gripwheel apparatus, and in accordance with the herein described assemblage method, the manner illustrated in FIGS. 1, 2, and 4 being as enabled to ring a driver's shank, the shank of a driver-type-as-afore-described-herein, the ringing being as such that "fixed-directly-to-the-shank" so encircling engaged with to spin the shank, the alternate manner in FIG. 5A being as enabled-to-ring-a-driver'shank but ringing as being "either/or" similar to FIGS. 1, 2, and 4, in that being either "immediate" the shank or differing in that being like one of the alternate manners of the guide's assemblage, by ringing-another-component-ringing-the-shank, the ringing in-either-sense additionally being such that loosely so permitting the-wheel to-be-spun-about/relative-the-shank, the shank collinear-with/at the axis for the spin, yet the wheel's ringing still as engaged to the shank, but the engagement differing in that being by linkage through way of a drive-train, the specific means utilized in FIG. 5A for engaging the shank being a-geared-internal-drive-train.
FIG. 5*b* is a partial-cross-section side view of the driver's rear-handle-fore-portion 25, the fore-portion depicted in the FIG. 5A front view, and reveals the outside housing 40 of the fore-portion 25 plus the section that was cutaway, the cutaway section still shown but in phantom; the figure helps to further illustrate the alternate manner revealed in FIG. 5A for having the wheel engage the shank to spin the shank, the alternate manner being to engage the shank by linkage through a drive-train, the specific illustrated means being a geared-internal-drive-train; but note that FIG. 5*b* illustrates only components which may be used in accomplishing assembly of the drive-wheel as-upon-a-driver-device such that part of the apparatus and in accordance with the herein described method of assembly, none are parts required by the method of assembly or are parts comprised intrinsic the apparatus to which the method of assembly relates.
FIG. 6 is a side plan perspective view of the gripwheel-handle-apparatus of either FIG. 2, FIG. 4, or FIG. 5A, but in FIG. 6 the gripwheel is shown in whole form assembled as mounted unexploded about a drive-device of a type as afore-described, the driver having both alternate embodiments of its rear-driver-handle-fore-portion, 25 of FIG. 4 and 25 of FIG. 5A, one used with the apparatus's drive-wheel engaging the shank by manner of fixing the wheel to the shank, the other used with the apparatus's drive-wheel engaging a shank by way of a drive-train, both fore-portions being depicted in phantom, one superimposed over the other, while attached to the rest of a driver's handle shown in phantom.
FIG. 7 is a side plan view of a gripwheel-handle-apparatus assembled upon a driver-device-of-a-type-as-afore-described illustrating both the work end of the driver and the operating end of the driver, revealing that the work end of the driver is the work end of the driver-device's shank the shank's work end in FIG. 7 also being the free end of the shank; additionally, the figure illustrates the operating end of the driver, and in FIG. 7 the operating end of the driver also is the operating end of the driver-device's handle.
FIG. 8 is a bottom plan perspective view of the gripwheel-handle-apparatus shown isolated from a driver-device-of-a-type-as-afore-described and is revealing both the internal face of the drive-wheel and a bore through the drive-wheel.
FIG. 9 is a top plan perspective view of the grip-wheel-handle-apparatus shown isolated from a driver-device-of-a-type-as-afore-described and is revealing the bore through the guide.
FIG. 10 is a side plan exploded view of the gripwheel-handle-apparatus illustrating a stage in a process which could be utilized for attaching the apparatus about a driver-device's shank, the shank being of a driver-type-as-afore-described-herein, such that assembled in accordance with the herein required assemblage method, the stage as whereby the slip ring type hand-held-guide is being slipped into place loosely discretely girdling the shank of the driver-device by perpendicularly inserting the shank through a-bore-through-the-guide, the bore of a type as illustrated in FIG. 9.
FIG. 11 is a side plan view of a type ratchet-driver-tool, a tool from a genre of tools having a handle with a shank extending perpendicularly from the handle, the tool being of a preferred type driver-device upon which a gripwheel-handle-apparatus would be assembled, the genre being a genre of tools upon which can be assembled a gripwheel apparatus; the FIG. 11 being such that showing the tool isolated from the grip-wheel-handle-apparatus.
FIG. 12 is a sequence of side plan views revealing the recommended hand operations for utilizing the gripwheel-handle-apparatus as assembled upon a driver-device-of-a-type-afore-described and includes arrows denoting the direction of forces applied by the hand to the apparatus and through the apparatus to the driver-device.

DETAILED DESCRIPTION OF THE APPARATUS TO BE ASSEMBLED, THE INVENTED METHOD OF ASSEMBLAGE-AS-ATTACHED-UPON-A-DRIVER-DEVICE, AND THE TYPE DRIVER-DEVICE OF WHICH THE APPARATUS IS ASSEMBLED UPON

FIG. 1, an exploded perspective side view of the grip-wheel handle apparatus reveals the apparatus is comprised of two halves, the slip ring type hand-held-guide half 13 and the hand operated drive-wheel half 14. As is illustrated in the FIG. 1, the structure of the guide-half and the drive-wheel half is such that they are separate, positioned, shaped, utilized, and functioning component-parts, parts that as-used-in-combination are the apparatus-to-be-assembled-in-accordance-with the-method-described-herein. The FIG. 1 also reveals that for the parts to be used as the apparatus they need to be sized such that the distance from at lease one axially-parallel-outward-surface of the guide to-a-line-to-be true axis of the guide, the line being through-the-guide, is essentially the same as the distance from the overall axially parallel outward surface of the drive-wheel to the axis of the drive-wheel, additionally the structure of the parts need to be such at a driver-device's shank, the driver-device's being of a type already having a handle with shank extending perpendicularly from the handle, is able to be located collinear with/at the common axis of both the guide and wheel, by having the shank running perpendicularly through 30 and 31 of the guide and wheel such that the guide and wheel are positioned in fine upon the shank, and both the guide and the wheel need to be sized along with being positioned in line about a shank, the shank being at/collinear-with their true-axis such that a hand is able to grasp the two components simultaneously, and the hand-held-guide's shank-parallel-outward-surface, illustrated in FIG. 1 by showing the guide's shank-parallel-outward-surface concavely shaped and sharply curved, needs to be shaped as to enable holding in position on the guide 13 any portion of a hand-grasping-on-the-shank-parallel-outward-surface of the said guide 13, while the drive-wheel's shank-parallel outward-surface needs to be shaped for ease of being, simultaneously, along with the holding of the guide 13 by a one portion of a hand, the drive-wheel being intermittently gripped, held, spun, and released by the grasp of any remaining not utilized on the guide, second portion of the same said hand, as illustrated in FIG. 1 by having the wheel's shank parallel outward surface convexly shaped and bluntly curved but additionally, the drive-wheel 14 being that is to be separate utilized in that independently enacted while half the apparatus, needs to have its bluntly-curved-shank -parallel-outward-surface substantially-uniformly-symmetrical-about-the-axis-of-the-wheel to enable the wheel to rotate within/as relative the grasp of the releasing, not-utilized-on-the-guide, second portion of the said hand such that the, not-utilized-on-the-guide, second portion of the said hand will be able to remain in position for gripping the wheel yet also will be able to rotate about the drive-wheel, near or lightly touching the drive-wheel's surface, due to the guidance by anchoring through linkage with the said hand's one portion which remains utilizing the guide 13, the guide additionally needing to be discretely independently free-to-be-spun. And the FIG. 1 also helps to illustrate "the method of assemblage" by showing the guide 13 as "enabled" to be assembled about a driver-device's shank so in accordance with the method of assemblage the method being as comprising having the guide half the apparatus 13 attached-about-such-that "girdling so as free from axially-rotatably-engaging a driver-device's shank, the driver-device being of a type having a handle and a shank extending perpendicularly from the handle, the shank used as axis for the guide's rotation by way of having the shank loosely-discretely inserted into, as rotatable relative while running perpendicularly through, a bore 30 through the guide, the guide linearly-retained-in-it's-location-about-the-shank, the location being juxtaposed adjacent-in-line-forward the drive-wheel half the apparatus, which-also-rings-the-shank, the guide thereby being nearer the shank's work-end than the wheel, the guide as, aforesaid-girdling, also being discretely independently free to be spun unlimited in distance and/or direction relative the driver's shank as axis for the spin and relative the apparatus's drive-wheel being separate, in that utilizable as independently enacted, while a component half the apparatus". And to be as afore described assembled upon-a-driver-device's-shank as in-accordance-with-the-herein-required-method the guide in FIG. 1 is enabled so as to utilize one manner out either of only two alternate manners possible in which the guide can be assembled as afore-described, the manner used in FIG. 1 being having the bore 30 through the guide sized such that the diameter is large enough to permit the shank to be inserted "loosely-fitted perpendicularly through the bore" so the guide will girdle loosely "immediate of", to spin directly upon the-shank-as-an-axial, the specific means utilized effecting the guide's freely able to be spun, regardless of the manner in which the bore is about the driver-device's-shank, as being there is only one means, is to have the surface area-throughout-the-guide's-bore axially rotatably smooth enough while the open area throughout the guide's bore is loose enough about the shank so that the guide will not rotationally engage the shank-as-an-axil inserted through the guide's bore but yet be tight enough about the shank to still permit the guide to be linearly retained in its location about the shank by a retainer such as retainer ring 16 FIG. 1 which can be clipped onto a shank in front of the guide blocking its linear movement. And lastly, the FIG. 1 further helps to illustrate the method of assemblage by showing that the drive-wheel 14 is enabled to be about the same driver-device's shank as-the-guide-girdles and in accordance with the herein required method of assemblage, the method as additionally comprising having the wheel-half-the-apparatus "ringing so axially rotatably encircling, utilizing a manner of engaging to spin the driver-device's shank, the shank being both perpendicularly running through the wheel and used at/collinear with true axis for the wheel's rotation, the wheel linearly retained in its location about the shank, the location being juxtaposed adjacent in-line-rearward the guide-half-the-apparatus and further away from the shank's work end than the guide, which-also girdles-the-shank the wheel thereby being forward the fore-portion of the driver's handle and nearer the fore-portion than the guide, the driver's handle extending from plus engaging with the shank's portion emanating from opposite-the-side-of-the-apparatus from-the-side-facing-the-shank's work-end, the wheel being as, aforesaid-engaging, also being such that will spin the shank when spun, while the guide is being such that will spin discretely independent the wheel when spun". And to be as afore described assembled upon-a-driver-device's-shank in-accordance-with-the-herein-described-method, the wheel is "enabled", such as illustrated in the FIG. 1, to-be-assembled-as-described by way of using one out of either of only two alternate manners in which the drive-wheel can be assembled as such, the manner used in FIG. 1 being having the wheel ringing-the-driver's-shank-directly-fixed-to-the-shank-directly so the wheel "encircles-engaged-with-to-spin-the-shank", but the specific means utilized to effect such fixed engagement can be any one of several, the one used in FIG. 1 being means of jagged ridges 15*a* inside a through-the-drive-wheel's bore, the bore sized small enough for the shank to be tightly press fitted perpendicularly through the bore, the jagged ridges thus digging Into the shank's surface thereby fixing the wheel to the shank. Such direct engagement for the drive-wheel enables the wheel to directly spin the shank upon rotation of the wheel.

FIG. 2, another exploded perspective side view of the gripwheel handle apparatus illustrates the alternate manner of having the guide 13 as assembled-upon-a-driver-device's-shank so a part of the apparatus, the manner also being such that when utilized in lieu of the manner illustrated in FIG. 1, the guide is still being assembled as In accordance with the assemblage method required herein, the required method comprising having the guide "girdling-a-driver-device's-shank, the driver-device being of a type as afore-described, the girdling being as discretely independently freely-able-to-be-spun including relative the shank and the apparatus's drive-wheel", the alternate manner being as the guide 13 configured to "loosely girdle the shank through way of loosely-girdling-another-component-ringing-the-shank"; and the alternate manner in the FIG. 2 does render attachment in accordance with the herein described assemblage method by means of having the drive-wheel's hub extended, the hub extension 18 inserted through a bore 30 through the guide 13, the bore sized large enough for insertion of the hub to be as "loosely fitted perpendicularly through the bore 30", "thereby the guide loosely-girdles-the-wheel's-hub-18 discretely independently free-to-be-spun unlimited in distance and direction relative the hub", but the hub 18 in turn is enabled to be mounted"ringing-a-driver's-shank so encircling-as-engaged-with-the-said-shank", the hub's ringing of the shank being at the same location relative the hub's length as where the hub is being girdled by the guide, and so to ring the shank, the hub 18 in FIG. 2 is configured having a bore 31 through the hub 18 to be used for insertion of the shank such that press fitted through the bore, the bore possessing internal surface ridges for digging into so fixing the hub upon thereby engaging the shank, thus the guide 13, through way of a driver-shank's insertion through the hub's bore 31, will, as in accordance with the herein described method of assemblage, "loosely-discretely-girdle-a-driver's-shank, the guide discretely-independently-free-to-be-spun, unlimited in distance and direction including relative the shank as axis for the guide's spin and relative the apparatus's drive-wheel as a separate and discretely-functioning component half of the apparatus" but additionally relative the wheel's hub as axis-for-the-guide's-spin unitized with the wheel so to be "part-of-the-wheel" yet being "pierced-through"-by-the-shank as axis-for-the-guide while also being within the hub inserted through the guide's bore; and the FIG. 2 also illustrates that the guide can be linearly retained, functional as afore-described, location-fixed-about-the-shank, by showing a retaining means such as ring 17 of FIG. 2 which can be dipped onto the end of the hub retaining the guide by blocking the linear movement of the guide. The FIG. 2 additionally illustrates one manner out-of-either-of-two-usable, one being same one as illustrated in FIG. 1, for enabling the wheel to be mounted such that engaging the same-shank-that-the-guide-girdles so in accordance with the herein described assemblage method, the assemblage method comprising having the drive-wheel "ringing-and-engaging-the-shank to spin the shank", the manner illustrated in FIG. 2 enabling the attachment in accordance with the herein assemblage method being "having the wheel enabled to be fixed-to-a-shank", but the specific means shown in FIG. 2 and utilized to execute the manner enabling the wheel to be "fixed to a shank", being as that the specific means is different-from-FIG.-1 and thus reveals that the means could have been any one out of several and yet still be in accordance with the herein described method of assemblage, as for example the wheel could have been glued onto-ringing the shank or press fitted onto-ringing the shank like in FIG. 1, or formed-out-of-an-expanded-portion-of-the-shank-itself, and thereby onto ringing the shank, etc., is in the FIG. 2 by way of incorporating a unitized drive-wheel and hub construction, the hub 18 engaging the shank by utilizing the same manner and means as the wheel used in FIG. 1 for engaging the shank, the manner being "fixed" to the shank and the means being by way of a bore like the bore through the wheel in the FIG. 1, but piercing through the hub, the bore still possessing internal surface ridges which will be caused to dig into a shank's surface when the bore is tightly press fitted onto a shank, but when the hub 18, utilizing the bore, is "fixed" onto the shank, so will the wheel be fixed onto the said shank and thus the wheel also will be engaging-upon-the-said-shank, all through way of the unitized construction. A cut away of the hub in FIG. 2 reveals the shank engagement means 15*a*.

FIG. 3, an external side plan perspective view of the gripwheel handle apparatus, shows the gripwheel components of either FIG. 1 or FIG. 2 as they would appear relative each other while assembled-upon-a-driver-device-of-a-type-afore-described-herein while also such that assembled in accordance with the method of assemblage described herein. As illustrated in FIG. 3, when either gripwheel embodiment of FIG. 1 or FIG. 2 is assembled-for-utilization-about-a-driver-device as in FIG. 3, both figures are depicting the same gripwheel overall structure, use, and barring various physical means applied as applications to the embodiments of the apparatus so to enable assembly of the embodiments, such as 30 and 31 of FIGS. 1 and 2; 15*a* of FIGS. 1, 2, and 4; 16 of FIGS. 1 and 4; 17 of FIGS. 2 and 4; 15 D of FIG. 5A, each embodiment of the apparatus is configured to be assembled in accordance with the same-method-of-assemblage described-herein so that the embodiment s am assembled about a driver's shank positioned in-the-location-of/collinear-with what is an axis for the apparatus.

FIG. 4, containing a partial cross sectional front view of the gripwheel handle apparatus of FIG. 2, shows the apparatus placed ready for operation assembled upon a phantom outlined portion of a driver-device-of-a-type-as-afore-described-herein. Viewing the FIG. 4 while reading the description which is to follow will help illustrate the gripwheel's assemblage as such that attached upon the driver-device. The gripwheel's method of assemblage comprises the-grip-wheel-utilize-an-area-on-the-driver'-shank-33 which, as seen in FIG. 4, is "between the driver-handle's fore-portion 25 and the work end of the driver's shank 33, the work end of the shank in FIG. 4 also being the free end of the shank; utilizing the required area on the shank along with requirements to follow herein will permit the gripwheel functionality as herein described. So continuing the description, additionally as seen in FIG. 4, the method requires the guide half 13 of the gripwheel apparatus to be assembled-about-the-driver's-shank-33 utilizing the afore-described area-on-the-driver's-shank but to describe further in greater detail, the guide is mounted such that "loosely discretely, axially-rotatably, girdling the shank 33 so as free from axially-rotatably-engaging the driver's shank, the shank being used as axis for the guide's rotation, as like the shank 33 In FIG. 4 running perpendicularly through the guide, the guide linearly retained in the guide's location-about-the-shank by way of the guide as sandwiched in position between other components which block the linear movement of the guide, other components being as comprising the drive-wheel 14 in FIG. 4 which is on one side of the guide and a retainer such as the C-camp 17 in FIG. 4 which is on the other side of the guide, and the location of the guide about the shank, as FIG. 4 reveals, is juxtaposed adjacent-in-line-forward the drive wheel half the apparatus 14 FIG. 4, which-also-rings-the-shank 33, the guide 13 FIG. 4 being nearer the shank's work end than the wheel 14 FIG. 4, the shank's-work-end being like shank's end 28 in FIG. 6, and the guide, being as afore-described girdling, is therefore also discretely independently free-to-be-spun unlimited in distance and/or direction relative the driver's shank as axis for the guide's spin and relative the apparatus's drive-wheel as a separate, being that utilizable independently enacted, component half the apparatus, the attachment of the guide as afore-described and in accordance with the assemblage method is through way of inserting the shank 33 perpendicularly-through a bore through-the-guide like bore 30 revealed in FIG. 2, the bore larger in diameter than the shank and piercing through the guide, the shank, as 33 in FIG. 4, inserted to a distance through the guide's bore so the bore is rearward of a line with the shank's work end 28"; and the assemblage method also requires the drive-wheel-half-14-of-the-gripwheel-apparatus, as is revealed in FIG. 4, to be assembled as such that attached-about-the-driver's-shank-33 but to describe further the method in greater detail, the wheel is attached such that "ringing so axially rotatably encircling, utilizing a manner of engaging to spin, the said driver-device's shank 33, the shank being both perpendicularly running through the wheel 14 and being such that as/at collinear with true axis for the wheel's rotation, the wheel 14 linearly retained in its location about the shank 33 by also being sandwiched between other components which block the linear movement of the wheel, the location being juxtaposed adjacent in-line rearward the guide-half-the-apparatus 13 and farther away from the shank's work end 28 than the guide 13 FIG. 4 which-also-girdles-the-shank, the wheel thereby being forward the fore-portion 25 FIG. 4 of the driver device's handle 27, 27 as revealed in FIG. 6, and nearer the handle's fore-portion than the guide 13, the driver's handle 27 extending from plus engaging with the end of the shank 33 emanating from opposite-the-side-of-the-apparatus-from-the-side-facing-the-shank's work-end 28, the wheel being as, afore-said-engaging, also being such that will spin the shank when spun while the guide is being such that will spin discretely independent both the wheel and shank when spun", thus in accordance with the method of assemblage, the driver's handle is inline rearward the drive-wheel the drive-wheel is in turn, inline juxtaposing rearward the guide, and the guide is in turn in line rearward the work end 28 of the shank 33; and, lastly required by the method of assemblage, both gripwheel halves, the guide 13 and the drive-wheel 14 are mounted-in-line-upon-the-driver-device's-shank such that "advantageously positioned near enough each other between the fore-portion of the driver's handle 25 and the driver-shank's work end 28, such that a single hand is able to simultaneously grasp both the guide 13 and the drive-wheel 14 utilizing them as bi-longitudinally supporting gripwheel-handle-apparatus halves". Now, the method of assemblage, which is the invention herein, defines a specific, uniquely-contrived set of fixed and variable relationships that are impressed upon the parts of the gripwheel-apparatus relative each other plus relative the driver-device, relationships involving distance, size, shape, orientation, and freedom of slippage between specific surfaces. Those relationships when applied to the ingredients the gripwheel parts along with driver-device, results in their, as together, being attached such that uniquely operable; however, the actual-physical-manner-used-to-achieve-the-assemblage-in-accordance-with-the-method is external the method's specifics and therefore can differ while the assemblage still remains in accordance with the method. Yet however, the manner of assemblage in the FIG. 4 is achieved by utilizing the same "manner" of the guide's assemblage and the same "manner" of the wheel's assemblage as illustrated in FIG. 2, the guide's manner of assemblage in FIG. 2 being having the hand-held guide 13 loosely-girdling-the-shank-33 through way of "loosely-girdling-another-component", the other component being the drive-wheel's hub 18, "the girdling-of-the-shank-through-way-of-another-component" being through way of having the shank 33 perpendicularly inserted running longitudinally through the hub 18, the hub 18 being in turn perpendicularly inserted running through the guide's bore 30, thus both the shank and the hub are simultaneously running through the guide's bore, the shank being as running longitudinally through the hub at the same location relative the length of the hub as the hub, in turn, is longitudinally running through the guide's bore 30, thus the guide loosely girdles the shank through way of loosely girdling another component, the other component being the hub 18. The "drive-wheel's" manner of assemblage in the FIG. 4, like in the FIG. 2, is by having the wheel 14 ringing so as "fixed" to the shank through way of the unitized construction of the drive-wheel 14 with a hub 18, the hub being fixed onto the shank 15*a* FIG. 4 by being press fitted onto the shank, thus both the hub and the wheel, together as unitized, are fixed-onto-the-shank and plus engage-the-shank by way of the hub's being fixed 15*a* onto the shank 33, but each of the aforementioned manners shown in FIG. 4, the manner of attaching the guide and the manner of attaching the wheel, is just a one out of two possible manners for each the guide and the wheel, alternate manners which can be utilized and still have the guide and the wheel mounted in accordance with the required method of assemblage, the gripwheel appearing mounted about the shank as illustrated in FIG. 4 And lastly seen illustrated in FIG. 4, when the drive-wheel utilizes the manner-of-engaging the shank by being fixed to the shank the engagement manner isn't requiring any necessary involvement of the driver-handle's fore-portion 25.

FIG. 5A, a partial cross sectional front view of the gripwheel-handle-apparatus, has the apparatus assembled ready for operation about a phantom outlined portion of a driver-device, but while FIGS. 1, 2, and 4 illustrate the manner of the drive-wheel's engagement-with-a-shank-to-spin-the-shank as being by way of the wheel's ringing "fixed to" thus engaging the shank, the FIG. 5A illustrates the alternate engagement manner of the drive wheel, alternate to that illustrated in FIGS. 1, 2, and 4, thus showing the gripwheel can be assembled in an alternate manner and still be in accordance with same assemblage method, the alternate manner being to have the wheel 14 FIG. 5A loosely ring the shank 33 FIG. 5A so spinable relative the shank, the wheel's-ringing-the-shank being either "immediate of the shank " or by way of "loosely-ringing-another-component-ringing-the-shank" like the afore-described manner of the guide's girdling the shank, but the wheel 14 in addition engaging the shank through linkage by way of a drive-train; the specific means utilized to illustrate the train in FIG. 5A, and being also the means which effects the engagement, is a geared-internal-drive-train 15D. And the FIG. 5A also illustrates the preferred component parts of the geared-internal-drive-train as being the following: a beveled driving-gear 20, loosely girdling the shank 33 but centered and fixed to, and therewith directly-engaging 15*b* upon, the drive-wheel's internal face 32, revealed in FIG. 8; the beveled driving-gear 20 FIG. 5A engaging a beveled idler-gear 21, able to be spun as mounted at its center about an axil affixed to the driver handle's fore-portion 25; the same beveled idler-gear 21 engaging a beveled step-up-gear 22 able to be spun as mounted at its center about an axil affixed to the driver handle's fore-portion 25; the beveled step-up-gear engaging a driven-gear 23 which is ringing so encircling as fixed to 15*c* thus engaged with to spin the driver's shank 33; and the gearing arrangement 24, a repeat of the aforementioned arrangement 21–22, which can be repeated in bilaterally symmetrical fashion on the shank's, driven-gear's, and driving-gear's opposite side. Also illustrated in FIG. 5A and differing from FIG. 4, the driver-handle's fore-portion 25, due to involvement of the drive-train with the handle's fore portion, is shown configured so to have the gears of the drive-train 15*b* spin about axils perpendicularly affixed to the handle's fore-portion.

FIG. 5*b,* a partial-cross-section side view of the driver's rear-handle-fore-portion 25, a portion of the handle which also is depicted in FIG. 5A as a front view, reveals the outside housing 40 of the fore-portion 25 and the section that was cutaway, the cutaway section still shown but in phantom; the figure helps to further illustrate the alternate manner revealed in FIG. 5A for having the wheel engage the shank to spin the shank, the alternate manner being by way of through linkage using a drive-train, the specific means illustrated being a geared-internal-drive-train. As the figure reveals, the driver-handle's housing 40 can be configured so as to wrap behind the step up-gear 22 for use as a platform to mount the idler gear 21 but note that the FIG. 5*b* illustrates only components used in a-particular-manner of assembling the apparatus's drive-wheel as attached upon a driver-device, and none are required by the method of assemblage or are intrinsic parts of the gripwheel handle apparatus, itself.

FIG. 6, a side plan perspective view of the gripwheel-handle-apparatus shown in either FIGS. 1, 2, 3, 4, or 5A, illustrates the apparatus assembled upon a phantom outline of a driver-device, the driver-device shown having both alternate embodiments of the rear-driver-handle-fore-portion 25 of FIG. 4 and 25 of FIG. 5A in phantom, one superimposed over the other, while they are attached to the rest of a driver's rear-handle 27 also shown in phantom. As illustrated by virtue of FIG. 6 being representative of all the embodiments FIGS. 1, 2, 3, 4, and 5A, when the gripwheel embodiments are assembled as upon a driver-device, the embodiments have essentially the same overall form, configuration, structure, and use, barring various physical means external to the gripwheel embodiments and assemblage method which may be utilized as a manner of accomplishing assemblage as 30 FIGS. 1 and 2; 15*a* of FIGS. 1, 2, and 4; 16 of FIGS. 1 and 4; 17 of FIGS. 2, and 4; plus 15 D of FIG. 5A; and although various physical means are utilized to accomplish assemblage of the gripwheel-embodiments-as-upon-a-driver-device, they are assembled as-upon-a-driver-device utilizing those means so as to carry out a manner of assemblage in compliance with the method of assemblage required herein FIG. 7, a side plan view of a gripwheel handle apparatus assembled upon a driver device, illustrates both the work end 28 and operating end 29 of the driver's device. As the FIG. 7 reveals, the work end of the driver is also the work end of the driver's shank, 33 in FIG. 7, the work end of the driver's shank 33 in FIG. 7 also being the free end of the shank. Also revealed in FIG. 7 is the driver's operating end 28 depicted as operating end of the driver's handle 27. Lastly, as revealed in FIG. 7, is the orientation of the gripwheel's component parts relative both the driver's work end 28 and operating end 29, and as FIG. 7 shows, the gripwheel, 13 and 14, is positioned between 28 and 29.

FIG. 8, a bottom plan perspective view of the gripwheel handle apparatus shown isolated from a driver-device, reveals the internal face 32 of the drive-wheel and a bore 31 through the wheel. As the FIG. 8 helps to reveal, both the bore 31 and internal face 32 are drive-wheel configurations which could be utilized as means for enabling the wheel to be mounted ringing a driver-device's shank so encircling engaged with the said shank and in accordance with the herein described assemblage method, as for example, the means could comprise having the wheel's bore sized for insertion of the driver's shank, while the inner surface of the bore is dressed to be fixed to the shank as 15*a* of FIG. 4, a manner of "engaging" the shank by "fixing" the wheel directly to the shank, or the means could comprise having the bore sized to loosely ring the shank so the wheel is rotational relative the shank, the ringing either being as directly ringing the shank, immediate the shank yet loosely, or indirectly-by-way-of-ringing-another-component-ringing-the-shank, the ringing ether directly or indirectly being as like the afore-described manners in which the guide can be enabled to girdle the shank, but the wheel's ringing of the shank being while the "internal face 32" of the drive wheel is dressed to engage the shank as like 15 D in FIG. 5A, "dressed-to-engage-the-shank" meaning by manner of linking-the-wheel-as-engaging-the-shank-through-a-drive-train. But note the shank itself can be expanded to form the drive-wheel component and thereby, as being-a-part-of-the-shank, the wheel would be as fixed to thus engaging the shank, such a manner of forming the wheel out of the shank itself makes a bore irrelevant. Any of the aforementioned wheel attachment manners enables the wheel to be assembled-about-the-driver-device's-shank in accordance with the method of assemblage required herein.

FIG. 9, a top plan perspective view of the gripwheel handle apparatus shown isolated from a driver-device, reveals a bore 30 through the slip ring type hand-held-guide. As the FIG. 9 helps to illustrate, a bore 30 is a constant element always part of any manner used to enable the guide be assembled as attached loosely girdling the shank of a driver-device so discretely-independently freely-able-to-be-spun about/as-relative the shank. But when the bore is viewed in FIG. 9 it is also important to understand that the means utilized to enable the guide be freely able to be spun includes sizing of the bore so large enough with inner surface smooth enough to be loose about, as not to engage but allow slippage of, a shank perpendicularly inserted as spinable like an axil through the bore; and being the bore's sizing must accommodate the diameter of the component girdled, the sizing also depends upon the manner of the guide's girdling spinable the shank, as the guide may girdle either immediate the shank or by way of girdling another component girdling the shank, therefore the bore may be any one of various sizes accommodating the diameter of the girdled component, yet the guide will still be mounted as girdling in accordance with the method of assemblage required herein.

FIG. 10, a side plan exploded view of the gripwheel handle apparatus, depicts the assembly In a process of being assembled about a driver-device's shank, the process at a final stage whereby the slip ring type hand-held-guide is being placed. An explanation of the FIG. 10 in generalized terms following herein helps exemplify how both components, the guide and the wheel, can be assembled as attached upon a driver-device such-that in accordance with the method of assemblage described herein. In the FIG. 10 the apparatus's slip ring type hand-held-guide 13 is being slipped into place "loosely-discretely-girdling-the-shank-33-of-the-driver-device-and-separate-the-apparatus's -drive-wheel-14" such that the guide is "discretely independently freely-able-to-be-spun unlimited in distance and direction relative both the driver's shank 33 and the apparatus's drive-wheel 14"; being as-such, the guide is in accordance with the method of assemblage. The properties of the guide, afore-described, along with those of the wheel are realized because the process of attachment leaves the components assembled as in accordance with the method of assemblage. The guide is being placed-about-the-shank rotationally-unengaged-to-both-the-shank and the drive-wheel, separated-from-both yet enclosing the shank in the fashion of a-ring-about-the-shank, the ring about the shank substantially mooring the guide freely-spinable-in-position-about-the-shank, so the guide is as attached to the shank, the shank being both the only portion of the driver-device about which the guide is moored plus being used as axil about which the guide is able to be spun freely relative both the shank and the drive-wheel 14, the drive-wheel 14, in the sense being considered-from-within-the-apparatus, being thereof a discretely independently-functioning half-the-apparatus engaged-the-shank while yet rotationally separated from the guide; however, when considering the wheel from the external view, "as part the assembled-unit", the apparatus-operated-by-a-single-hand, the wheel is used in-combination-with-the-guide enabling mutual functionality of the two. The process thus leaves the components arranged in a state-in-accordance-with-the-method-of-assemblage prepared for being linearly fixed in location about the shank by a manner which will retain the properties of the guide and wheel as afore-described, and the method of assemblage does include the guide and wheel being linearly retained in their orientations and location relative the shank. So given all as afore-described, the process of attaching the gripwheel apparatus illustrated in FIG. 10 and explained herein in generalized terms is as follows: The shank 33 is inserted through a bore 30 piercing through the guide, the bore larger in diameter than the shank and loose about the shank, the shank inserted running perpendicularly through the guide's bore such that the bore is about-the-shank positioned a distance back from the shank's work end 28, of the guide girdling rearward of, in line with, the shank's work end, and the guide also is retained in the guide's location about the shank by a retainer such as retainer ring 16 FIG. 10; and the location the guide girdles on the shank is juxtaposed in line forward the work side of the drive-wheel 14 FIG. 10, the dive-wheel ringing to encircle the shank but utilizing a manner of "engaging upon the shank 33 FIG. 10 to spin the shank 33", the location the wheel rings on the shank being even farther in line rearward on the shank than the guide's location from the work end 28 of the shank; and in addition, the wheel's location is such that ringing the shank in line forward the work-end 25 of the driver's handle 27, 27 as revealed in FIG. 7, the handle's work-end being the fore-portion 25 FIG. 10 of the handle 27 revealed in FIG. 7, the handle being a "part of the driver-device" which is attached engaging upon and in line with the rear-end of the driver's shank 33, the rear end of the driver's shank being the opposite shank-end from the shank's work-end 28, the driver's handle having always been a "part-of-the-driver-device" attached to the shank to spin the shank 33, and the wheel as located, afore-described, also is linearly retained in the location-rearward-the-guide by virtue of the wheel being rearward of a retainer such as the retainer that is forward the guide, retainer ring 16 of FIG. 10, and the wheel additionally is retained in the location relative the shank by either being forward the fore-portion of the driver's handle, or by being forward another retainer as like 16 FIG. 10 used forward the fore-portion of the driver's handle, or by having the wheel directly fixed to the shank, thus the driver's handle is in line rearward the drive-wheel 14, the drive-wheel is in turn, juxtaposed, in line rearward the guide 13, and the guide is in turn, in line rearward a retainer that is in turn in line rearward the work end of the shank; and both the gripwheel halves, the guide and wheel, are mounted advantageously positioned near enough each other between the fore portion of the driver's handle 25 and the driver's work end 28, such that a single hand is able to simultaneously grasp both the guide and drive-wheel utilizing them as bi-longitudinally supporting halves FIG. 11 is a side plan view of a "preferred type driver-device". As the FIG. 11 is helping to reveal, the driver-device is from a genre or driver's having-a-handle-with-a-shank-extending-perpendicularly-from-the-handle, the handle being for spinning the shank, the genre being also a genre of tools from which can come a tool of which the gripwheel handle apparatus is able to be assemble upon. The tool is shown isolated from the gripwheel apparatus.

Referring now to FIGS. 1, 2, 3, 4, 5A, 6, 7, 10, and 11, revealing all the apparatus elements to be assembled, the device upon which the apparatus is to be assembled, and the method of assemblage-the invention herein, will help describe the entire assemblage method in context, The gripwheel handle apparatus FIG. 3, being a means for guiding and actuating, comprises both a slip ring type hand-held-guide-half 13 and a hand-operated drive-wheel-half 14, each used in conjunction with the other, both assembled as the apparatus in-accordance-with-the-assemblage method upon a driver-device of genre shown in FIG. 11, a genre having a handle with shank extending perpendicularly from the handle, such that the apparatus is located between the work end 28 of the driver-device's shank 33, as revealed in FIG. 6, and the work end of the fore-portion 25 of the driver-device's handle 27 also revealed in FIG. 6. The hand-held-guide half the apparatus 13, as revealed In FIG. 10, is assembled upon a driver-device by method of loosely discretely, axially rotatably, girdling the driver-device's shank so as free from axially-rotatably-engaging the driver's shank 33, the shank 33 being as axis for the rotation of the guide relative the shank 33, the guide being as linearly retained in its location-on-the-shank, the location being juxtaposed adjacent-in-line-forward the drive wheel half the apparatus, 14 FIG. 10, which-also-rings-the-shank, the guide thereby being nearer the shank's work end 28 FIG. 10 than the wheel, the guide being as, aforesaid girdling, also being discretely independently freely-able-to-be-spun, unlimited in distance and/or direction including relative both the driver's shank 33 being axis for the guide's spin, and relative the apparatus's drive-wheel 14 being separate, in that utilizable independently enacted, while a component half the apparatus and the manner of the guide's afore-described assemblage as attached about a driver-device's shank is through way of loosely girdling the shank, the girdling being either as "immediate" of the shank by way of having the shank alone inserted through a bore piercing through the guide, the guide's bore having been sized enabling a "loose" insertion of the shank as running perpendicularly through the bore, the insertion being as like the insertion of the shank through the bore 30 in FIG. 10, or alternatively, having the guide girdle the shank by "indirectly" as through way of a bore 30 through the guide sized, as like bore 30 in FIG. 2, for loose insertion of another component 18 FIG. 2 through the guide's bore, the guide thus loosely girdling the other component 18, but the other component 18 to ring a driver's shank 33 FIG. 10 at the same location relative the length of the other component as the guide does loosely girdle the other component, thus the guide will loosely girdle a driver's shank through way of loosely girdling the other component, the shank still being as the axis for the guide's spin. And the only means that is utilized to effect the guide's being freely-able-to-be-spun-about-a-shank is that of having the guide's bore configured large enough with inner surface smooth enough so as not to rotationally engage either directly or indirectly with the shank inserted as axis perpendicularly through the guide's bore, while yet having the bore small enough to still permit the guide to be "fixed linearly" relative the shank by retainer such as the retainer ring 16 FIG. 10 or 17 FIG. 2. Now, as different from the guide, the "drive-wheel 14", revealed in FIG. 10, is assembled upon a driver-device's shank by method of ringing such that encircling "engaged with the driver's-shank 33", the wheel linearly retained in its location about the shank, the location being juxtaposed adjacent in line rearward the guide-half-the-apparatus and further away from the shank's work end 28 FIG. 10 than the guide 13 FIG. 10, which-also-girdles-the-shank, the wheel thereby forward the fore-portion 25 of the driver's handle 27, 27 as revealed in FIG. 7, and nearer the fore-portion 25 than the guide, the driver's handle 27, extending from plus engaging with the shank's portion emanating from opposite-the-side-the-apparatus-from-the-side-facing-the-shank's-work-end 28 FIG. 10, the wheel being as, aforesaid engaging, also being such that will "spin the shank 33 when spun" while the guide is being such that instead will spin discretely independent the wheel and shank when spun, and the manner in which the wheel is assembled as said, "ringing plus engaging a driver's shank", is either by "directly engaging" the shank through "ringing fixed" to the shank or alternatively by "indirectly", as engaging the shank while ringing the shank loosely, as spinable relative the driver's shank; the loose ringing of the shank being either as immediate of the shank or by way of ringing-another-component-ringing-the-shank, the ringing "immediate of or by way of another component" being like the afore-described manner in which the guide girdles the shank, but in addition the wheel "engaging" the shank through linkage utilizing a drive train, the drive train utilized only when the wheel is utilized girdling-the-shank spinable relative the shank, the shank being also/stiff as at/collinear-with true axis for the wheel's spin; and the means used to effect the wheel's engagement can be any of several, for example one being a jagged bore through the wheel sized to be press fitted about/ringing the shank 15*a* FIGS. 1, 2 and 4, the wheel engaging the shank through being directly "fixed"-upon-the-shank, the means-fixing-the-wheel-upon-the-shank being also the means that couples and translates the spin of the wheel to spin of said shank; or another being a geared internal drive train 15D in FIG. 5A used, when in addition to the wheel's ringing of the shank, the wheel also is spinable relative the shank, the train attached in the manner having part the train directly "fixed"-upon-the-wheel linking the "wheel 14" to an internal-driven-gear-15*c* of the train, the-internal-driven-gear of the train to be mounted ringing-a-driver's-shank 33 FIG. 5A in the manner "ringing directly fixed-upon-the-shank", the "wheel" engaging the shank through being "linked-to-the-shank", the means linking-the-wheel-upon-the-shank being also the means which couples and translates spin of the wheel to spin of said shank, the shank still as being at/collinear with true axis for the wheel's spin; either means resulting in the wheel's engaging the shank to spin said shank and both the guide 13 and drive wheel 14, as like that of FIG. 6, are positioned about a driver's shank 33 FIG. 6 such that they are near enough each other enabling a single hand to utilize both: the guide and the wheel simultaneously, and the movement linearly of the guide 13 relative the shank 33 is such that the guide 13 is linearly retained in location upon/relative the shank by way of the guide's "sandwiched position" meaning that of having the guide either-as or as-not forward a retainer but being forward-the-drive-wheel and yet rearward a retainer, retainers such as 16 FIG. 1 or 17 FIG. 2 affixed to the shank; and the drive-wheel 14 is linearly retained in location upon/relative the shank 33 by either the wheel's engagement-manner-upon-the-shank-33 which can be that of "fixing the wheel to the shank 33", or by way of the wheel's "sandwiched position" meaning having the wheel either-as or as-not reward a retainer, but being rearward-the-guide which is yet rearward-a-retainer, retainers such as 16 FIG. 1 or 17 FIG. 2 affixed to the shank, but yet also the wheel either-as or as-not forward another retainer, such as 16 FIG. 1 or 17 FIG. 2 affixed to the shank, or, being-that-the-wheel-already-is-forward-the-fore-portion-of-the-driver's-handle 25, as just abutting the driver's handle, the handle being a part-of-the-driver already affixed to the driver's shank, thus the wheel and guide are linearly fixed in location upon/relative the driver by/being assembled such that mounted-about -relative the driver's shank.

Referring now to FIGS. 7, 11 and 12, using a preferred method of operating the gripwheel handle apparatus, the apparatus here assembled upon a driver-device of a ratchet driver type, the operator would fist grasp the slip ring type hand-held-guide 13 FIG. 7 between a thumb and at least one finger of a hand, the first portion 38 FIG. 12 of hand-one 36 FIG. 12, to guide the driver's shank 33 FIG. 7 toward work, FIG. 12 OPERATION 1, and thereupon, the operator would keep the first hand portion 38 upon the guide to use the first hand portion for guiding and holding the shank against the work, and at the same time the user would rock the driver's rear handle 27 FIG. 7 counter clockwise using the second hand 37 FIG. 12, a return stroke of the second hand in preparation for the hand's next productive rotation, the return stroke continuing until the second hand reaches maximum rotational extension, FIG. 12 OPERATION 2. While the second hand 37 FIG. 12 is moving to its maximum counter clockwise extension, the operator would bear down and grip the 14 FIG. 7 hand-operated-drive-wheel with the hand-one's second portion 39 FIG. 12, which remained as not-utilized-for-holding-onto-the-guide 13, so to rock the shank-engaged drive-wheel 14 clockwise thus spinning the shank 33 clockwise, FIG. 12 OPERATION 2. The hand one portion 38 FIG. 12 holding onto the guide would continue to hold onto the guide during all operations allowing the guide to fulfill another role which is that of being means to anchor the hand-one 36 FIG. 12 In just such an advantageous position to have the hand one's second portion 39 not utilized on the guide 13 grasp to spin as needed the shank engaged drive-wheel 14 so to spin the shank 33. Note that when the apparatus is mounted about the shank of a ratchet-driver-device, such as the driver of FIG. 11, and the driver is used on loose fitted work, just holding the drive-wheel 14 FIG. 7 during return strokes of the rear-shank-handle 27 FIG. 7 will augment the ratcheting action of the driver. Spinning of the drive-wheel 14 will, on any driver fitted with the apparatus, further spin the shank if spinning is applied during normally unproductive return-stroke periods of the driver's rear handle 27 FIG. 7. Continuing to describe the gripwheel's operation, when both hands of the operator reach maximum rotated extensions in their respective rotating directions, FIG. 12 OPERATION 2, the operator would then release the hand-one second-portion 39 FIG. 12 from gripping upon the drive-wheel, FIG. 12 OPERATION 3, releasing the drive-wheel 14 and thereupon, reverse 37 FIG. 12 OPERATION 3, the second hand's rotation-of-the-driver's-rear-handle thus to rock the handle clockwise, the second hand 37 then would be the means continuing the clockwise spin of the shank by clockwise spinning the rear-handle 27 which engages the shank through the driver's ratchet means. Both the hand one's second-portion 39 which is released away from the drive-wheel, along with the hand one's first-portion 36 which remains on the guide, would now freely reverse direction bringing along in rotation the slip ring type hand-held-guide 13 still being held by the hand one first portion; all three would rock counter clockwise about plus above the clockwise-moving drive-wheel which is moving in the opposite direction due to linkage through the shank spun by the second hand's spinning of the driver's rear handle, FIG. 12 OPERATION 4. The hands would continue their movement in their respective directions until all arrive at their maximum extensions, the starting position FIG. 12 OPERATION 1, where upon the hands would begin another cycle of gripwheel plus driver-device use.

Referring cow to FIGS. 1, 3, 5A, and 6, the method of attaching the apparatus's drive-wheel half, 14 FIG. 3, upon-a-driver-device in accordance with the method of assemblage comprises having the wheel ring a driver-device's shank to engage the shank 33 FIG. 6. In realizing such an attachment in accordance with the method of assemblage, the manner in which the wheel rings the shank to engage the shank can be in either one of two ways, one being ringing the shank to engage the shank by being fixed to the shank, as for example by using 15*a* FIG.1 a jagged bore through the wheel to be press fitted about the shank fixing the wheel to the shank 33 FIG. 6, but note, the means used to effect the wheel's being fixed to the shank to engage the shank can be any one of many, for example another means would be to adhere the wheel 14 to the shank by glueing or another means would be to have the shank itself expanded to form the drive-wheel component. Now referring back to the manner of the wheel's attachment, the other manner in which the wheel can ring the shank to engage the shank is to while the wheel loosely rings the shank rotational relative the shank either as "immediate" the shank or as-like-the-afore-described-indirect-manner-of-the-guide's-girdling-the-shank through way of ringing another component ringing the shank, have the wheel additionally engage the shank through linkage by way of a drive train, a train such as the geared internal drive-train 15D in FIG. 5A. Turning attention now to the 13 FIG. 1 slip-ring-type "hand held guide", the hand-held-guide's method of attachment upon-a-driver-device as in accordance with the method of assemblage comprises having the guide loosely and discretely girdling the shank of a driver-device and separate the apparatus's drive-wheel such that resulting in the guide's being discretely independently freely-able-to-be-spun, unlimited in distance and direction including relative the driver's shank as axis for the spin and relative the apparatus's drive-wheel being separate, as utilizable independently enacted, while a component half the apparatus. In realizing such an attachment in accordance with the method of assemblage, the manner in which the guide is enabled to be as said freely spun can be in either one of two ways, one way being to have the guide loosely girdle the shank, as "immediate" of the shank, for example by utilizing 30 FIG. 1, a bore through the guide used for having the driver's shank, alone, inserted perpendicularly running through the bore, the shank loosely fitted so the guide is rotational relative the shank immediate of the guide; and the other way being to have the guide loosely girdle the shank by way of having the shank inserted through another component, as for example, by utilizing a bore 30 FIG. 3 through the guide, the bore sized and used for having the other component inserted through the guide's bore, but while the other component is inserted perpendicularly running through the guide's bore, the shank is inserted-perpendicularly-running-through-the-other-component, " passing-through-the-same-portion-of-the-other-component" relative the length of the other component as the other component is passing through the guide's bore, thus both the shank and the other component are inserted perpendicularly, as-one-about-the-other, through the guide's bore, the shank still loosely fitted through the guide's bore such that the guide is rotational relative the shank therefore the guide is still freely able to be spun discretely independently about/and-as-relative the shank. Now the means used to effect having the guide be, as said, able to be spun freely about the shank is, rather than being more than one, only one means, that being having the guide mounted girdling the shank as not able to engage the shank rotationally, either in direct or indirect manner, by having the guide's only relationship with the shank the bore, configured large enough such that the guide will be loose about the shank, resulting in a complete unbroken separation between the guide and shank, the separation so smooth and circular about the shank as not to enable the guide and shank to engage yet the guide as still encircling the shank so anchored upon thus attached to the shank. And lastly, the method of attaching both the guide and wheel comprises their being linearly retained in their respective locations about the shank as aforesaid functional. In using the said attachment method, the manner in which the guide and wheel are retained can be any of several, but for example, being that the components are already retained on one side relative shank, by way of the driver's handle already being attached there, the components can be retained on the other side relative the shank by means of retainer rings such as 16 and 17 of FIG. 6. But note, retainer rings can also be used on the handle side of the components.

Referring to FIGS. 6 and 12, the operation of the apparatus isn't affected by the setting of a driver's ratchet-direction-setting-means 26 FIG. 6 as the hand is merely lifted off the drive-wheel 14 FIG. 6 during drive-wheel return stroke. The hand's operating position and stance are maintained during the lift via anchoring of the hand by the griping of the hand's first portion 38 FIG. 12 upon the slip ring type hand-held-guide 13 FIG. 6. The hand-held-guide 13 FIG. 6 will support lifting of hand one's second portion 39 FIG. 12 and the return stroke operation because the guide is mounted-in-accordance-with-the-herein-described-assemblage-method rotationally free relative both the shank and wheel yet movement-of-the-guide-linearly relative-both-the-shank-and-wheel is location-fixed-about-the-shank relative both shank and wheel by the guide's movement blocked linearly as through way of the guide's sandwiched position between retainers such as 16 and 17 of FIG. 6 and/or other component parts. The guide being so-retained rotational in location relative the shank is therefore able to be spun in concert with any portion of a hand 38 FIG. 12 gripping upon the guide thus the guide will "guide" and free any unencumbered, as not gripping upon the guide, second portion of the same hand 39 FIG. 12, to move rotationally as needed, bear down, grip, hold, or grip plus spin the drive-wheel 14 FIG. 6.

It should be noted and understood that drawings and descriptions herein are illustrative of the gripwheel apparatus's appearance and the means both depicted and described herein to effect the gripwheel's attachment as in accordance with the method of assemblage are illustrative of types which could be utilized; therefore if the gipwheel apparatus to be assembled is of type having structure within the scope of the prescribed structure as hereinafter claimed and the assemblage of the gripwheel components are within the scope of the assemblage method as hereinafter claimed, then various materials, colors, and embodiment shapes plus various physical means to effect attachment of each gripwheel component may be used without departing from the spirit and scope of the invention, the assemblage method, as hereinafter claimed.

What is claimed is:

1. A device for imparting driving force to a screw, comprising:

a shaft;

a handle disposed on said shaft;

a first member freely rotatable about said shaft; and a second member disposed adjacent and at least partially outside said first member, which is fixed to the shaft.

2. The device of claim 1, wherein said first member has a hole to receive said shaft therein.

3. The device of claim 1, wherein said second member has a hole in its center to receive said shaft therein.

4. The device of claim 1, wherein said second member is molded to said shaft.

5. The device of claim 1, wherein said first member is substantially disc shaped.

6. The device of claim 1, wherein said first member is shaped to receive a user's hand.

7. The device of claim 1, wherein said second member is substantially disc shaped.

8. The device of claim 1, wherein said first member is positioned on said shaft anterior of said second member.

9. A device for use in imparting force to a screw, comprising:

a shaft;

a handle disposed on said shaft;

a first member freely rotatable about said shaft; and a second member disposed adjacent and at least partially outside to said first member, which can engage said shaft.

10. The device of claim 9, wherein said first member is continuously freely rotatable.

11. The device of claim 9, wherein said second member continuously engages said shaft.

12. A method for driving a shaft, comprising:

gripping a first member and a second member with a user's first hand;

holding a handle of the shaft with the user's second hand;

turning said second member in a first direction, while still gripping said first member, so as to rotate the shaft; and releasing the user's grip on said second member while (1) rotating said first member in a second direction, freely, without said first member ever rotationally engaging the shaft, and simultaneously, (2) gripping and rotating said handle in the first direction so as to continue to rotate the shaft.

13. The method of claim 12, further comprising the step of releasing the user's grip on said handle of the shaft while the user is turning said second member in a first direction so as to rotate the shaft.

14. The method of claim 13, wherein the user maintains a grip on said first member.

15. The method of claim 12, wherein said handle is a ratchet.

* * * * *